US008047769B2

(12) United States Patent
Ballard, Jr.

(10) Patent No.: US 8,047,769 B2
(45) Date of Patent: Nov. 1, 2011

(54) INSPECTION PORT PLUG DEVICES

(75) Inventor: Henry G. Ballard, Jr., Easley, SC (US)

(73) Assignee: General Electric Company, Schenectady, NY (US)

( * ) Notice: Subject to any disclaimer, the term of this patent is extended or adjusted under 35 U.S.C. 154(b) by 938 days.

(21) Appl. No.: 12/027,707

(22) Filed: Feb. 7, 2008

(65) Prior Publication Data

US 2009/0202340 A1 Aug. 13, 2009

(51) Int. Cl.
*F01D 25/00* (2006.01)

(52) U.S. Cl. ..... 415/118; 415/135; 415/136; 415/138; 415/201; 60/39.821

(58) Field of Classification Search ..... 415/118, 415/135, 136, 138, 201; 60/39.33
See application file for complete search history.

(56) References Cited

U.S. PATENT DOCUMENTS

| | | | | |
|---|---|---|---|---|
| 3,362,160 | A * | 1/1968 | Bourgeois | 415/118 |
| 4,406,580 | A | 9/1983 | Baran, Jr. | |
| 4,815,276 | A | 3/1989 | Hansel et al. | |
| 5,115,636 | A | 5/1992 | Zeiser | |
| 5,185,996 | A * | 2/1993 | Smith et al. | 415/118 |
| 5,431,534 | A * | 7/1995 | Charbonnel | 415/118 |
| 5,867,976 | A * | 2/1999 | Ziegler, Jr. | 415/118 |
| 6,468,033 | B1 | 10/2002 | Weidlich | |

* cited by examiner

*Primary Examiner* — Igor Kershteyn
(74) *Attorney, Agent, or Firm* — Sutherland Asbill & Brennan LLP

(57) ABSTRACT

An inspection port plug device is provided for sealing three or more oppositely placed inspection ports in a multi-chambered gas turbine engine. An embodiment of the inspection port plug device includes a cap and at least two shafts coupled end-to-end. A first shaft includes a first end coupled to the cap and a second end having a first sealing plug, wherein the first sealing plug includes a recess. A second shaft includes a third end coupled to the first sealing plug within the recess and a fourth end having a second sealing plug. The first shaft and the second shaft also include a first biasing mechanism and a second biasing mechanism, respectively, for maintaining the seals at the first and second sealing plugs when the inspection port plug device is installed.

20 Claims, 4 Drawing Sheets

INSPECTION PORT PLUG DEVICES

BACKGROUND OF THE INVENTION

The subject matter disclosed herein relates generally to multicavity sealing of opposing ports in spaced apart walls and, more particularly, for sealing the inspection access ports in gas turbine engines.

Gas turbine engines operate in a very high temperature and pressure environment. These engines typically have multiple casings with spaced apart walls having oppositely placed ports for inserting any type of inspection devices such as borescopes, proximity probes, or laser probes for inspection or intermittent access to the gas path components and for monitoring the engine. These inspection ports need to be plugged or sealed after the inspection is completed to prevent leakage through the ports when the engine is in operation. In the past, the sealing surfaces have been limited to one or two sealing surfaces with a maximum of three operating pressures, for example, exterior, intermediate and gas path operating pressures. However, in newer engines, the number of simultaneous sealing surfaces may include three or more sealing surface.

Further, gas turbine engines have different temperatures in different casings that lead to differential thermal growth of the casings, leading to misalignment in the oppositely placed ports in the spaced apart walls of the casings. Another factor contributing to the misalignment of holes is the radial, axial and circumferential movement of various surfaces with respect to each other due to pressure, mechanical loads, and temperature variations in the different chambers. Misalignment of the multiple ports in the spaced apart walls may lead to leakage if the ports are not properly sealed, which can result in lowering the overall efficiency of the engine, degrade or damage engine components, and potentially pose a safety hazard to personnel if hot gases leak to the exterior of the engine.

BRIEF DESCRIPTION OF THE INVENTION

In light of the above problems, an inspection port plug device is provided for sealing ports between a plurality of opposing walls in a gas turbine engine.

In one embodiment of the invention, an inspection port plug device, which is a removable plug device, may include a cap that defines a first recess. A first shaft, having opposing first and second ends, is received in the first recess of the cap at its first end. The second end of the first shaft includes a first sealing plug that includes a second recess. A first biasing mechanism is coupled to the first end of the first shaft and biases the first shaft to extend outwardly in an radial direction away from the first recess. A second shaft, having opposing third and fourth ends, is received in the second recess of the first sealing plug at its third end. The fourth end of the second shaft includes a second sealing plug. A second biasing mechanism is coupled to the third end of the second shaft and biases the second shaft to extend outwardly in an radial direction away from the second recess.

In another embodiment of the invention, a turbine engine may include a removable plug device that seals at least a first inspection port in an external wall of the engine, a second inspection port in an intermediate wall of the engine substantially opposite the first inspection port, and a third inspection port in an innermost wall of the engine substantially opposite the second inspection port, and wherein the second and third inspection ports include a conical sealing surface. The plug device may comprise a cap that seals the first inspection port, wherein the cap includes an annular collar that defines a first recess at, at least, a first shaft and a second shaft. A first shaft, having opposing first and second ends, is received in the first recess of the cap at its first end. The second end includes a first sealing plug that defines a second recess. A first biasing mechanism is coupled to the first end of the first shaft and biases the first shaft to extend outwardly from the first recess so that the first sealing plug is biased in a sealing relationship with the second inspection port. The second shaft, having opposing third and fourth ends, is received in the second recess of the first sealing plug at its third end. The fourth end of the second shaft includes a second sealing plug. A second biasing mechanism is coupled to the third end of the second shaft and biases the second shaft to extend outwardly from the second recess so that the second sealing plug is biased in a sealing relationship with the third inspection port.

BRIEF DESCRIPTION OF THE DRAWINGS

The above and other advantages of the invention will be apparent upon consideration of the following detailed description taken in conjunction with the accompanying drawings, in which like reference characters refer to like parts throughout, and in which.

DETAILED DESCRIPTION OF THE INVENTION

The drawings illustrate the embodiments of the present invention and therefore the invention is described in light of the same.

Figure 1:
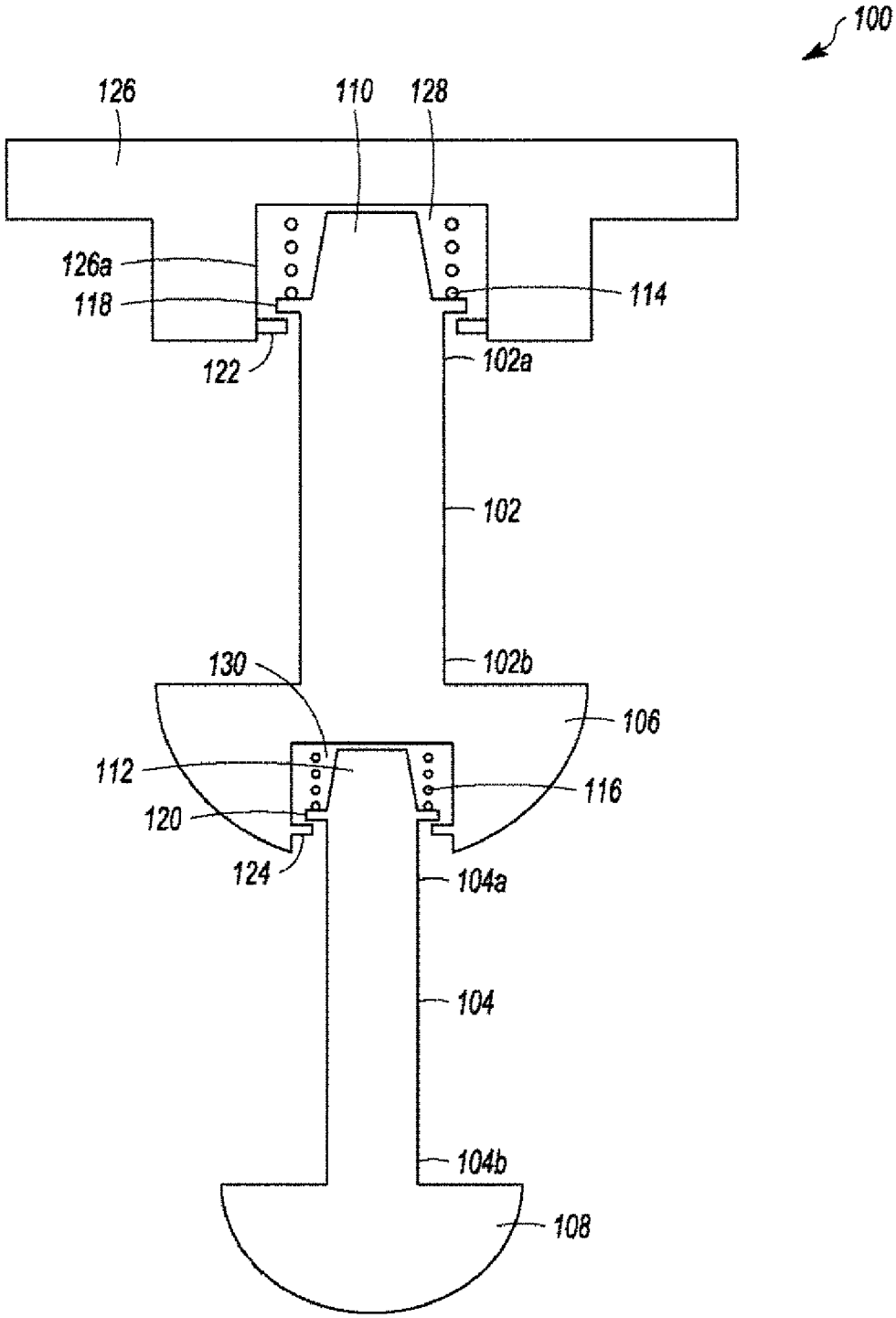
FIG. 1 illustrates a cross-sectional view of an inspection port plug device in an extended configuration in accordance with an embodiment of the invention.

FIG. 1 illustrates a cross-sectional view of an inspection port plug 100 device having two axial shafts, a first shaft 102 and a second shaft 104. In an embodiment of the invention, the inspection port plug 100 is a removable plug device. Each of the two shafts, the first shaft 102 and the second shaft 104, have axially opposing ends: a first end 102A and a second end 102B; and a third end 104A and a fourth end 104*b*, respectively. The inspection port plug 100 includes a cap 126 having an annular collar 126A, and a first retainer 122 inside the annular collar 126A. The annular collar 126A of the cap 126, along with the first retainer 122, forms a first recess 128 to receive the first end 102A of the first shaft 102. The second end 102B of the first shaft includes a first sealing plug 106. In an embodiment of the invention, the first sealing plug 106 is a hemispherical sealing plug. The first sealing plug 106 forms a sealing engagement in the form of a first line contact with the port formed by a conical surface in the corresponding wall of the gas turbine.

The first sealing plug 106 includes a second retainer 124, wherein the first sealing plug 106 and the second retainer 124 form a second recess 130 to receive the third end 104A of the second shaft 104. Similar to the second end 102B of the first shaft 102, the fourth end 104*b* of the second shaft 104 includes a second sealing plug 108. In an aspect of the invention, the second sealing plug 108 may be a hemispherical sealing plug. The second sealing plug 108 forms a sealing engagement in the form of a second line contact with the port formed by a conical surface in the corresponding wall of the gas turbine engine.

Further, a first shoulder 118 is provided at the first end 102A of the first shaft 102 to provide a locking mechanism for the first shaft 102 in the first recess 128. The first shoulder 118 may comprise an annular ring radially extending from and at least partially surrounding the first shaft 102. The first retainer 122 of the cap 126 prevents the first shaft 102 from moving out of the first recess 128 by locking the arrangement with the first shoulder 118. Similarly, the third end 104A of the second shaft 104 has a second shoulder 120, which provides a locking mechanism by engaging with the second retainer 124 of the first sealing plug 106 to prevent the second shaft 104 from moving out of the second recess 130. Similar to the first shoulder 118, the second shoulder 120 may comprise an annular ring radially extending from and at least partially surrounding the second shaft 104. In an embodiment of the invention, the first shoulder 118 and the second shoulder 120 have an arcuate surface at their distal ends to facilitate off-axis or radial movement of the first shaft 102 relative to the cap 126. The gap affords movement, but the shape of the interface keeps the first shaft 102 concentric to the first retainer 122 within the limits of the gap. The first shaft 102 is allowed to rotate about the center of this interface. The first end 102A of the first shaft 102 further includes a first neck 110, which extends from the first shoulder 118. Similarly, the third end 104A of the second shaft 104 includes a second neck 112, which extends from the second shoulder 120 to facilitate off-axis movement of the second shaft 104 relative to the first shaft 102. In an embodiment of the invention, the first neck 110 and the second neck 112 are frustoconical in shape to facilitate off axis movement of the shafts 102 and 104 relative to the cap 126 and one another, respectively. The frustoconical shape refers to the shape of a frustum of a cone, that is, a gradual taper towards the end of the shaft.

A first biasing mechanism 114 may be coupled to the first shoulder 118 and/or the first neck 110 of the first end 102A of the first shaft 102 to extend the first shoulder 118 in an outward radial direction away from the first recess 128. Similarly, a second biasing mechanism 116 may be coupled to the second shoulder 120 and/or the second neck 112 of the third end 104A of the second shaft 104 to extend the second shoulder 120 of the second shaft 104 in an outward radial direction away from the second recess 130. In one embodiment of the invention, the first biasing mechanism 114 and the second biasing mechanism 116 may include at least one of a spring, bellows, crest or wave spring, or any other suitable biasing device such as a force displacement device or constant force device, for example, a pneumatic piston. When the plug 100 is not installed, the biasing mechanisms 114 and 116 operate to extend the first and second shafts 102, 104 telescopically into one elongated co-axial manner. In addition, the first biasing mechanism 114 may have a greater stiffness than the second biasing mechanism 116 to prevent the second biasing mechanism 116 from affecting the seal between the first seating plug 106 and its corresponding port.

In an embodiment of the invention, the inspection port plug 100 comprises a plurality of shafts in an arrangement to seal the ports formed in a gas turbine engine having more than three spaced apart opposing walls. Each of the plurality of shafts has axially opposing ends similar to the first shaft 102 and the second shaft 104, where one end of the each of the plurality of shafts is having a sealing plug and the other end of the each of the plurality of shafts is received into the recess formed by the sealing plug of the previous shaft. The retainers, shoulders and biasing arrangement for the plurality of shafts is similar to the first shaft 102 and the second shaft 104 as explained in FIG. 2.

Figure 2:
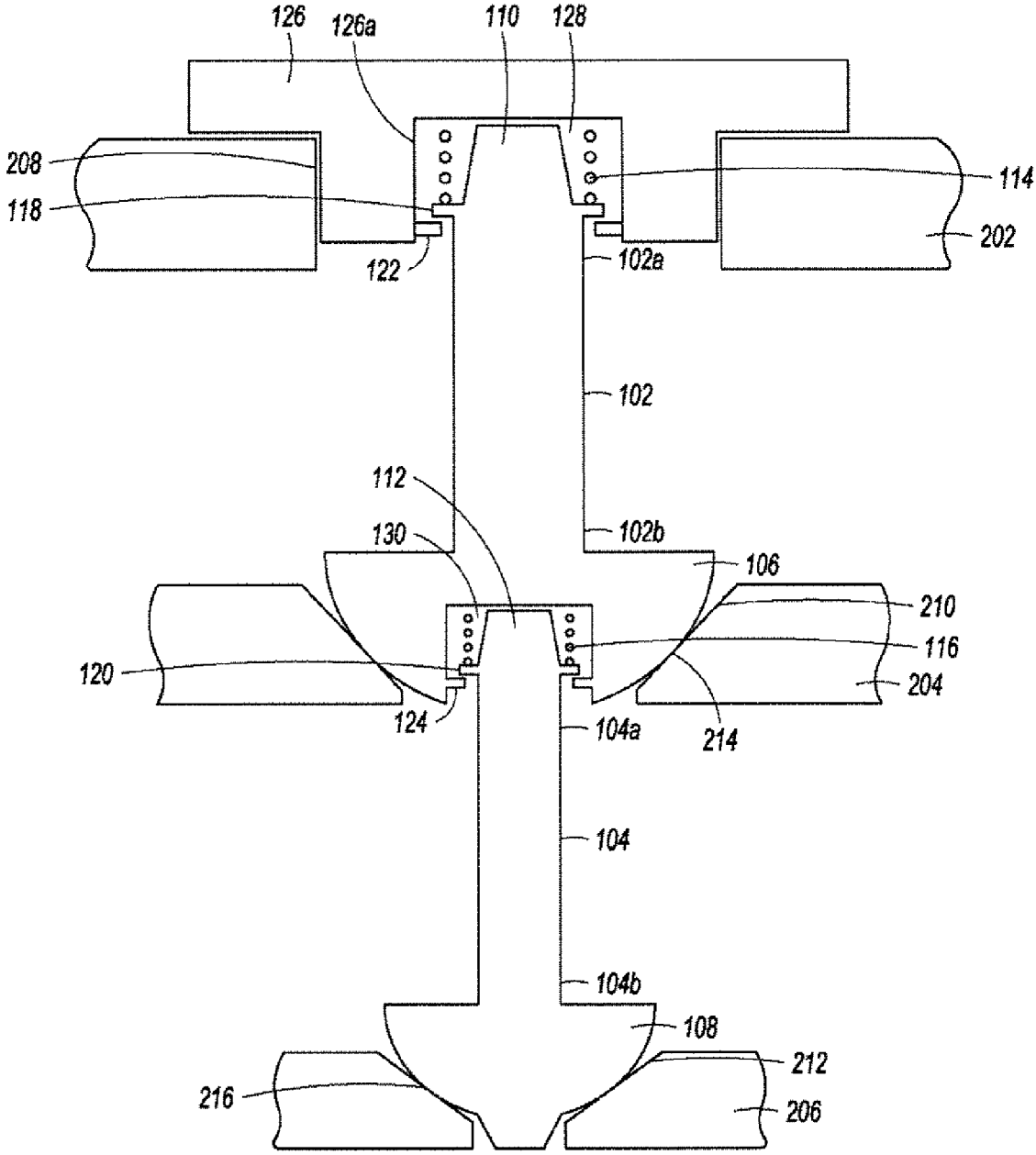
FIGS. 2-4 illustrates a cross-sectional view of an inspection port plug installed in a gas turbine engine experiencing different types of displacements possible such as radial, axial and circumferential displacements about the centerline of the gas turbine engine in accordance with an embodiment of the invention.

FIG. 2 illustrates a cross-section of the inspection port plug 100 of the FIG. 1 installed in a gas turbine engine. Typically, in gas turbine engines, there can be a plurality of opposing parallel and non-parallel walls and corresponding chambers. Inspection devices like borescopes or laser probes are required to pass through the ports between the walls to extend between the chambers. The walls can, for example, be for inner compressor, combustion chamber, turbine casing, fan duct or alike. Once the inspection devices are removed, the inspection ports between these walls are required to be plugged to prevent any leakage of flow from one chamber to another when the engine is in operation.

FIG. 2 shows an embodiment of the invention in connection with three such spaced apart opposing walls: an external wall 202; an intermediate wall 204; and an innermost wall 206. The inspection port plug 100 of FIG. 1 is used to simultaneously seal a first port 208, a second port 210 and a third port 212 formed by the external wall 202, the intermediate wall 204 and the innermost wall 206, respectively.

The cap 126 fits on the external wall 202 to seal the first port 208 by any suitable means such as bolted flange, o-ring, screw, etc. The first sealing plug 106 forms a first line contact 214 with a second port 210, which is conical in shape. In an embodiment of the invention, the first sealing plug 106 is a hemispherical sealing plug. The first line contact 214 formed between the first sealing plug 106 and the intermediate wall 204 seals the second port 210. To create a line seal, the first sealing plug 106 includes a male body that has a hemispherical shape and the first port 208 includes a female body that has a conical surface. In this manner, upon contact the spherical shape can rotate about its center and yet maintain line contact. The second sealing plug 108 forms a second line contact 216 with the third port 212, which is conical in shape. In an embodiment of the invention, the second sealing plug 108 is a hemispherical sealing plug. The second line contact 216 formed by the second sealing plug 108 and the innermost wall 206 seals the third port 212.

Figure 3:
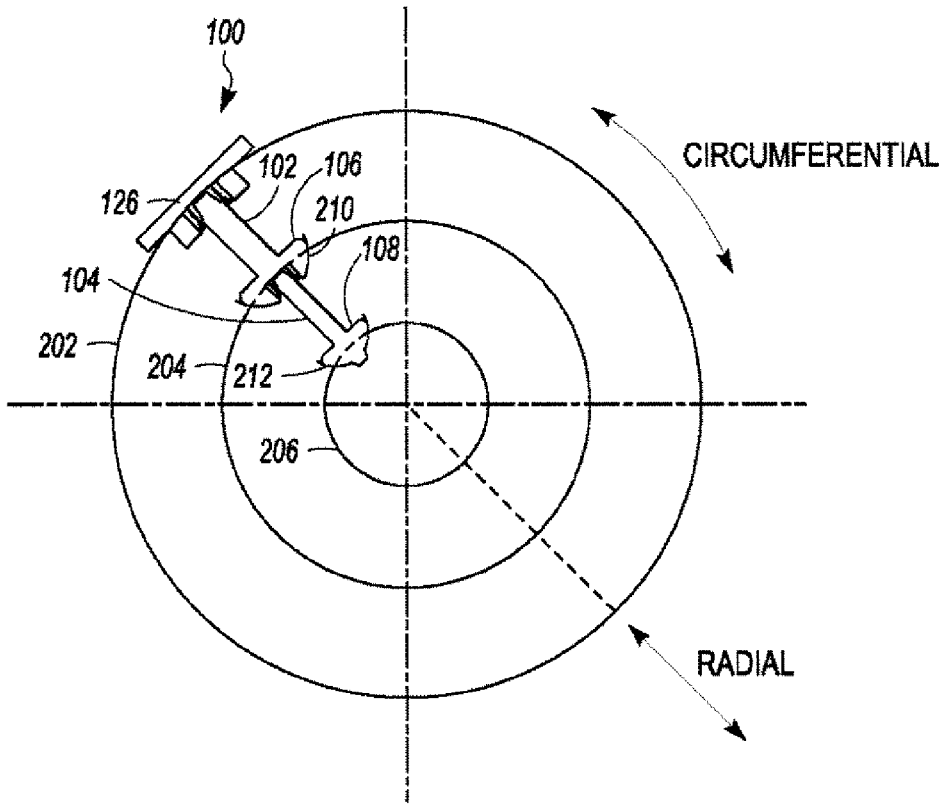
Figure 4:
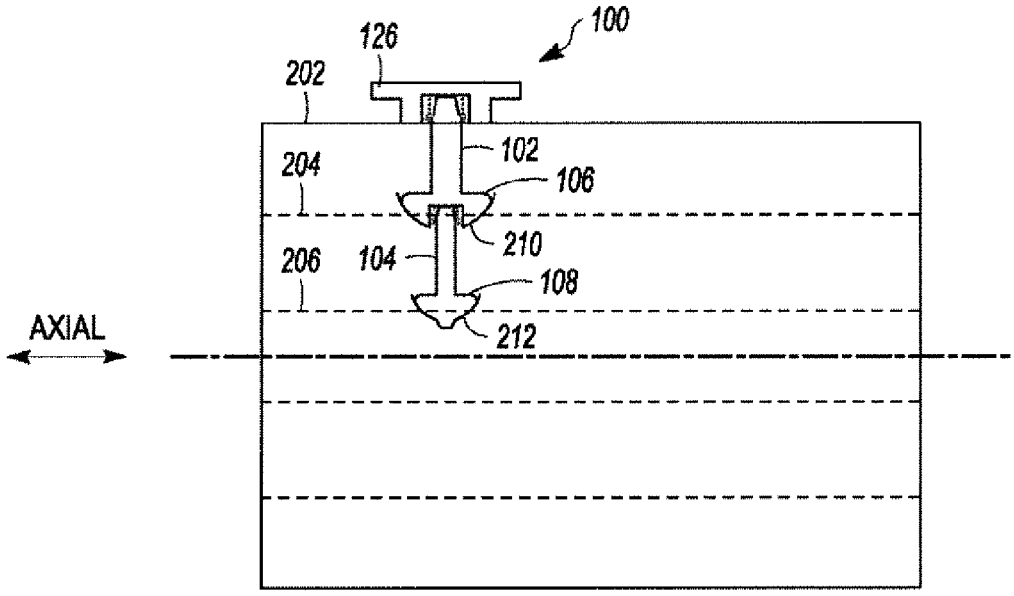

Referring to FIG. 3, with respect to the engine centerline, the engine radial direction is denoted as the direction emanating from the engine centerline, the engine circumferential direction as the direction along the circumference and the engine axial as shown in FIG. 3, and the engine axial direction as the direction along the engine centerline axis as shown in FIG. 4. Generally, the inspection port plug 100 is inserted in an engine radial direction, but may include directional components in the engine circumferential and engine axial directions. The fundamental seal is a ball within a conical socket; the ball may be the first sealing plug 106 or the second sealing plug 108, and the conical socket may be the first port 210 or the second port 212 respectively as illustrated previously in FIG. 2. Pressure differential across the seal could help provide sealing force if the greater pressure is on the side with the ball and the larger opening of the conical socket. Conversely, if the pressure were greater on the smaller side of the conical socket, a sufficient force should be applied to the ball to maintain a seal. Therefore, a sufficient spring force, along with a sufficient engine radial travel is required to maintain line contact in opposition of radial displacements of the walls. With sufficient force, the seal is maintained in case of relative engine radial, axial, or circumferential displacements between the walls. Such displacements may be the result of changes in temperature (for example, cold at shutdown to hot during operation) within each wall, 202, 204 and 206, changes of pressures within each cavity, or the application of varying mechanical loads on each wall, 202, 204 and 206 due to torque reactions, shear forces, force couples, piping load, stator tube supporting loads or any combination of these loads.

Referring again to FIG. 2, shows an embodiment of the invention, in which the intermediate wall 204 and the innermost wall 206 may experience displacements in the engine radial direction, due to the various loads described in FIG. 3 and FIG. 4. To maintain the first line contact 214 in the event of engine radial displacement, the first biasing mechanism 114 stops the first shaft 102 from moving upwards within a predetermined distance. The predetermined distance depends on the stiffness of the first biasing mechanism 114 relative to the stiffness of the second biasing mechanism 116. For example, it may be desired that the stiffness of the first biasing mechanism 114 is greater than that of the second biasing mechanism 116 to accommodate engine radial movement of the innermost wall 206 and the intermediate wall 204 towards one another.

The degree of engine circumferential displacement as well as engine axial displacement between walls, 202, 204 and 206, which can be accommodated is determined by the existing gap between the first retainers 122 and the initial position of the first shoulder 118 of the first shaft 102. Similarly, the existing gap between the second retainers 124 and the initial position of the second shoulder 120 of the second shaft 104 determines the relative misalignment that can be accommodated between the second port 210 and the third port 212. The degree of engine axial and circumferential movement that can be accommodated also depends on the length of the first shaft 102 and the second shaft 104. The greater the length of the first shaft 102 and the second shaft 104, then greater is the engine axial and circumferential misalignment that can be accommodated.

In an embodiment of the invention, the inspection port plug 100, as shown in FIG. 2, is a removable plug device. In case of a removable plug device, the overall diameter of the second sealing plug 108 should be less than the overall diameter of the minimum wall opening of the second port 210, and the overall diameter of the first sealing plug 106 must be less than the overall diameter of the minimum wall opening of the first port 208. As such, the inspection port plug 100 can be inserted and removed without obstruction.

Figure 5:
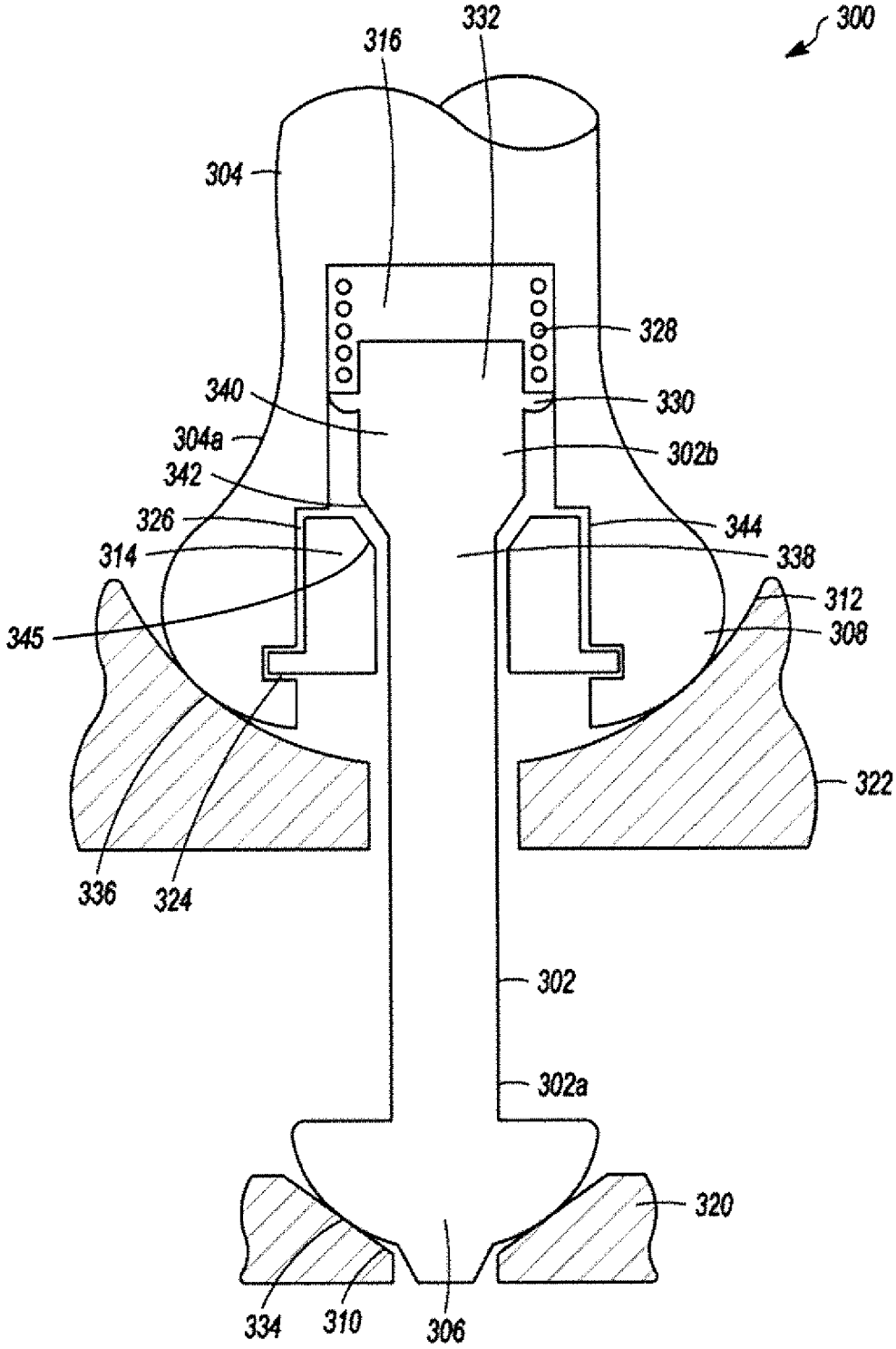
FIG. 5 illustrates a cross-sectional view of a portion of an inspection port plug device according to an embodiment of the invention.

FIG. 5 illustrates a cross-sectional view of a portion of an inspection port plug 300 device. In gas turbine engines, there can be a plurality of opposing walls and corresponding chambers. FIG. 5 illustrates an embodiment of the invention with two such opposing walls: an innermost wall 320; and a subsequent wall 322. The inspection port plug 300 includes a plurality of shafts, of which two shafts, an innermost shaft 302 and a subsequent shaft 304, are shown in the FIG. 5. The innermost shaft has a first end 302*a* and a second end 302*b*. For sake of simplicity, the cross-sectional view of the inspection port plug 300 shows only a third end 304*a* of the subsequent shaft 304. The first end 302*a* of the innermost shaft 302 includes an innermost sealing plug 306. The innermost sealing plug 306 forms a line contact 334 with an innermost port 310, which is conical in shape and formed by the innermost wall 320. In an embodiment of the invention, the innermost sealing plug 306 may be a hemispherical sealing plug. The line contact 334 formed by the innermost sealing plug 306 seals the innermost port 310.

Similarly, the third end 304*a* of the subsequent shaft 304 includes a subsequent sealing plug 308. The subsequent sealing plug 308 forms a surface contact 336 with a subsequent port 312, which is spherical in shape and formed by the subsequent wall 322. In an embodiment of the invention, the subsequent sealing plug 308 may have the anticipated surface contact region because of a hemispherical shape forming the sealing plug 308. This contact configuration may afford greater wear due to relative movement of the subsequent sealing plug 308 and the subsequent wall 322.

Further, a first recess 316, formed by the subsequent sealing plug 308 of the subsequent shaft 304 and a split block 314, receives the second end 302*b* of the innermost shaft 302. The second end 302*b* of the innermost shaft 302 may be tapered at a lower end 342 adjacent to an uppermost portion 340 of the second end 302*b* such that the uppermost portion 340 has a radius greater than the radius of a lower portion 338 of the innermost shaft 302. The uppermost portion 340 of the second end 302*b* is housed in the first recess 316, while the lower portion 338 of the first shaft 302 is housed inside the split-block 314. The split-block 314 is placed in a slot 344 defined by the inner surface of the subsequent sealing plug 308. The split-block 314 has a circular cross-section that encloses the lower portion 338 of the innermost shaft 302. The split block 314 being formed as a cylindrical part would be unable to be assembled onto the innermost shaft 302, should be at least cut in half through its axial centerline to be assembled. Once assembled onto the innermost shaft 302, the split block 314 is held within the end of the first recess 316 by a retaining part 324. The split-block 314 enables a locking arrangement, which prevents the innermost shaft 302 from coming out of the first recess 316. Further, the second end 302*b* of the innermost shaft 302 has a shoulder 330, which may comprise an angular ring that radially extends from and at least partially surrounds the innermost shaft 302. When the innermost shaft 302 moves outward, the tapered portion at the lower end 342 of the second end 302*b* engages the tapered part 345 of the split-block 314.

In an embodiment of the invention, a biasing mechanism 328 may be coupled to the innermost shaft 302 at the shoulder 330 and/or a neck 332 of the second end 302*b* of the innermost shaft 302. In an embodiment of the invention, the biasing mechanism may include at least one of a spring, bellows, crest or wave spring, or any other suitable biasing device such as a force displacement device or a constant force device, for example, a pneumatic piston. Referring again to FIG. 5, when the inspection port plug 300 assembly is removed from the engine and the biasing mechanism 328 fully extends the innermost shaft 302 outward, the taper part 345 of the split block 314 engages the tapered portion of the lower end 342 and the tolerance provided by the retaining part 324 between the split block 314 and the innermost shaft 302 is also closed or substantially closed, causing the innermost shaft 302 and the subsequent shaft 304 to be concentric with respect to the centerline axis except for some circumferential tolerance 326 necessary for assembly of the mechanism.

In another embodiment of the invention, the biasing mechanism is a spring that is compressed in an initial state when the inspection port plug device is installed and the engine is not in operation. The innermost wall 320 and the subsequent wall 322 are initially fixed relative to one another, and thereafter during the operation of the engine are displaced relative to each other. Such displacements are the result of changes in temperature, for example, cold at shutdown to hot during operation, within each wall, changes of pressures within each cavity, or the application of varying mechanical loads on each wall due to torque reactions, shear forces, force couples, piping load, stator tube supporting loads or any combination of these loads. These displacements may cause the innermost wall 320 and the subsequent wall 322 to experience engine radial displacements as described with respect to FIG. 3 and FIG. 4, in the same or opposite directions. To maintain the surface contact 336, the biasing mechanism 328 moves the innermost shaft 302 outward to accommodate the misalignment caused by the engine radial displacement.

In another embodiment of the invention, due to one or more of the above-noted displacements, the subsequent wall 312 and the innermost wall 310 of the FIG. 5 may experience an engine radial displacement. To maintain the surface contact 336, in case of the engine radial displacement, the biasing mechanism 328 stops the innermost shaft 302 from moving upwards within a predetermined distance. The predetermined distance may depend on the stiffness of the biasing mechanism 328 with respect to the degree of the engine radial displacement.

In yet another aspect of the invention, out of the plane displacements resulting from the combined effects described, may misalign the innermost port 310 with respect to the subsequent port 312. Such engine axial or circumferential, or combinations of both displacements may be accommodated at least in part with the biasing mechanism 328 in conjunction with the length of the innermost shaft 302.

The written description uses examples to disclose the invention, and also enabled any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An inspection port plug device for sealing a plurality of substantially opposed inspection ports on an engine, comprising, a cap that includes a first recess;

a first shaft having opposing first and second ends, wherein the first end is received in the first recess of the cap and the second end having a first sealing plug that includes a second recess;

a first biasing mechanism that is coupled to the first end of the first shaft and that biases the first shaft to extend outwardly in an radial direction away from the first recess;

a second shaft having opposing third and fourth ends, wherein the third end is received in the second recess of the first sealing plug and the fourth end having a second sealing plug; and a second biasing mechanism that is coupled to the third end of the second shaft and that biases the second shaft to extend outwardly in an radial direction away from the second recess.

2. The plug device of claim 1, wherein the second sealing plug includes a third recess, and the device further comprises a third shaft having opposing fifth and sixth ends, wherein the fifth end is received in the third recess of the second sealing plug and the sixth end having a third sealing plug, and a third biasing mechanism that is coupled to the fifth end of the third shaft and that biases the third shaft to extend outwardly in an radial direction away from the third recess.

3. The plug device of claim 1, wherein the first biasing mechanism generates a greater biasing force than the second biasing mechanism.

4. The plug device of claim 1, wherein the first biasing mechanism includes at least one of a spring, bellows, or crest and wave spring.

5. The plug device of claim 1, wherein the second biasing mechanism includes at least one of a spring, bellows, or crest and wave spring.

6. The plug device of claim 1, wherein the first end of the first shaft includes a first neck and a radially extending first shoulder, and wherein the first biasing mechanism engages the first shaft at the first neck and the first shoulder.

7. The plug device of claim 6, wherein the first shoulder includes an arcuate surface at a distal end thereof.

8. The plug device of claim 1, wherein the third end of the second shaft includes a second neck and a radially extending second shoulder, and wherein the second biasing mechanism engages the second shaft at the second neck and the second shoulder.

9. The plug device of claim 8, wherein the second neck of the second shaft is frustoconical in shape to enable off-axis movement of the second shaft relative to the first shaft.

10. The plug device of claim 1, wherein the first sealing plug and the second sealing plug are hemispherical in shape.

11. The plug device of claim 10, wherein the first sealing plug has a larger diameter than the second sealing plug.

12. The plug device of claim 1, wherein the cap includes a first retainer that limits radial movement of the first shaft relative to the cap.

13. The plug device of claim 12, wherein the first retainer of the cap is engaged by the first shoulder of the first shaft.

14. A removable inspection port plug device for sealing a plurality of substantially opposed ports on an engine, including a first port in an external wall, a second port in an intermediate wall, and a third port in an innermost wall, comprising, a cap that seals the first port, wherein the cap includes an annular collar that defines a first recess;

a first shaft having opposing first and second ends, wherein the first end is received in the first recess of the cap and the second end has a first sealing plug that includes a second recess;

a first biasing mechanism that is coupled to the first end of the first shaft and that biases the first shaft to extend outwardly from the first recess so that the first sealing plug is biased in a sealing relationship with the second port when the plug device installed;

a second shaft having opposing third and fourth ends, wherein the third end is received in the second recess of the first sealing plug and the fourth end includes a second sealing plug; and a second biasing mechanism that is coupled to the third end of the second shaft and that biases the second shaft to extend outwardly in an axial direction from the second recess so that the second sealing plug is biased in a sealing relationship with the third port when the plug device installed.

15. The device of claim 14, wherein the first end of the first shaft is tapered to facilitate off-axis movement of the first shaft.

16. The device of claim 14, wherein the first end includes a shoulder adjacent the taper, and at a distal end of the shoulder was an arcuate surface to facilitate off-axis movement of the first shaft.

17. The device of claim 14, wherein the second recess of the first sealing plug includes a split-block insert to retain the third end of the second shaft in the second recess.

18. A turbine engine, comprising:

a first inspection port in an external wall of the engine, a second inspection port in an intermediate wall of the engine substantially opposite the first inspection port, and a third inspection port in an innermost wall of the engine substantially opposite the second inspection port, and wherein the second and third inspection ports include a conical sealing surface;

a removable plug device that seals the first, second and third inspection ports, the plug device comprising, a cap that seals the first inspection port, wherein the cap includes an annular collar that defines a first recess, a first shaft having opposing first and second ends, wherein the first end is received in the first recess of the cap and the second end having a first sealing plug that includes a second recess, a first biasing mechanism that is coupled to the first end of the first shaft and that biases the first shaft to extend outwardly from the first recess so that the first sealing plug is biased in a sealing relationship with the second inspection port, a second shaft having opposing third and fourth ends, wherein the third end is received in the second recess of the first sealing plug and the fourth end including a second sealing plug, and a second biasing mechanism that is coupled to the third end of the second shaft and that biases the second shaft to extend outwardly from the second recess so that the second sealing plug is biased in a sealing relationship with the third inspection port.

19. The engine of claim 18, wherein the first end of the first shaft is tapered to facilitate off-axis movement of the first shaft.

20. The engine of claim 18, wherein the first end included a shoulder adjacent the taper, and at a distal end of the shoulder was an arcuate surface to facilitate off-axis movement of the first shaft.

* * * * *